US011029067B2

(12) United States Patent
Tomiyama et al.

(10) Patent No.: US 11,029,067 B2
(45) Date of Patent: Jun. 8, 2021

(54) REFRIGERATION APPARATUS WITH DEFROST DURING HEATING OPERATION

(71) Applicant: Daikin Industries, LTD., Osaka (JP)

(72) Inventors: You Tomiyama, Osaka (JP); Naoki Moroi, Osaka (JP); Tatsuya Makino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/623,930

(22) PCT Filed: Aug. 8, 2018

(86) PCT No.: PCT/JP2018/029827
§ 371 (c)(1),
(2) Date: Dec. 18, 2019

(87) PCT Pub. No.: WO2019/031561
PCT Pub. Date: Feb. 14, 2019

(65) Prior Publication Data

US 2020/0158392 A1 May 21, 2020

(30) Foreign Application Priority Data

Aug. 8, 2017 (JP) ..... JP2017-153079

(51) Int. Cl.
*F25B 47/02* (2006.01)
*F24F 11/42* (2018.01)

(52) U.S. Cl.
CPC ..... *F25B 47/025* (2013.01); *F24F 11/42* (2018.01)

(58) Field of Classification Search
CPC combination set(s) only.
See application file for complete search history.

(56) References Cited

U.S. PATENT DOCUMENTS 4,406,133 A * 9/1983 Saunders ..... F25D 21/006 62/155
4,940,079 A * 7/1990 Best ..... F24D 19/1072 165/236

(Continued)

FOREIGN PATENT DOCUMENTS

EP 2 695 758 A1 2/2014
EP 3 208 549 A1 8/2017

(Continued)

OTHER PUBLICATIONS

Form PCT/IB/338 of PCT/JP2018/029827 dated Feb. 20, 2020.
International Peliminary Report on Patentability of PCT/JP2018/029827 dated Feb. 11, 2020.

*Primary Examiner* — Henry T Crenshaw
(74) *Attorney, Agent, or Firm* — Birch, Stewart, Kolasch & Birch, LLP.

(57) ABSTRACT

A refrigeration apparatus includes a refrigerant circuit including a compressor, an outdoor heat exchanger, an expansion valve, and an indoor heat exchanger connected to each other, the refrigerant circuit being capable of executing at least a heating operation by circulating a refrigerant through the refrigerant circuit, and a control unit configured to start a defrosting operation for melting frost formed on the outdoor heat exchanger when a first defrosting start condition is satisfied in a case where a predetermined premise situation is not established and start the defrosting operation when a second defrosting start condition stricter than the first defrosting start condition is satisfied in a case where the predetermined premise situation is established. The predetermined premise situation is at least either a situation relating to unlikelihood of formation of frost on the outdoor heat exchanger progressing or a situation where a load of the heating operation is large.

4 Claims, 5 Drawing Sheets

(56) References Cited

U.S. PATENT DOCUMENTS

| | | | | |
|---|---|---|---|---|
| 2018/0238578 | A1 | 8/2018 | Nakata | |
| 2019/0154321 | A1* | 5/2019 | Takenaka | F25B 13/00 |
| 2019/0264965 | A1* | 8/2019 | Tanaka | F25B 13/00 |

FOREIGN PATENT DOCUMENTS

| | | | |
|---|---|---|---|
| JP | 59-145454 | A | 8/1984 |
| JP | 59-145455 | A | 8/1984 |
| JP | 62-190359 | A | 8/1987 |
| JP | 63-188448 | A | 8/1988 |
| JP | 07-229662 | A | 8/1995 |
| JP | 11-211186 | A | 8/1999 |
| JP | 2004-232942 | A | 8/2004 |
| JP | 2008-039299 | A | 2/2008 |
| JP | 2008-128609 | A | 6/2008 |
| JP | 2014-202367 | A | 10/2014 |
| WO | WO 2016/060145 | A1 | 4/2016 |
| WO | WO 2017/030068 | A1 | 2/2017 |
| WO | WO 2017122264 | A1 | 7/2017 |

* cited by examiner

REFRIGERATION APPARATUS WITH DEFROST DURING HEATING OPERATION

TECHNICAL FIELD

The present invention relates to a refrigeration apparatus.

BACKGROUND ART

In a conventional refrigeration apparatus which causes an outdoor heat exchanger to function as an evaporator for a refrigerant and causes an indoor heat exchanger to function as a radiator for the refrigerant, frost is formed on the outdoor heat exchanger during a heating operation and increases an air flow resistance of air passing through the outdoor heat exchanger, which may reduce the heating efficiency. Thus, a defrosting operation for melting the frost formed on the outdoor heat exchanger is appropriately performed.

For example, an air conditioner described in Patent Literature 1 (JP 63-188448 A) focuses on the fact that a frost formation condition in an outdoor heat exchanger varies according to the outside air temperature and humidity in an area where the air conditioner is used, and proposes that the outside temperature and humidity in the area where the air conditioner is used are taken into consideration in a reference temperature which is used in the comparison with the temperature of the outdoor heat exchanger as the start condition of the defrosting operation to perform an efficient defrosting operation.

SUMMARY OF THE INVENTION

Technical Problem

In the air conditioner described in Patent Literature 1, the same condition of the outside temperature and humidity results in the same value of the reference temperature in the start condition of the defrosting operation.

However, even when the outside temperature and humidity are in the same condition, the formation of frost may be less likely to progress in a state in which the surface of the outdoor heat exchanger is dry than in a state in which the surface of the outdoor heat exchanger is wet.

Further, even when the outside temperature and humidity are in the same condition, some user may want to more promptly improve the temperature environment inside the room by giving a higher priority to continuing the heating operation than performing the defrosting operation.

The present invention has been made in view of the above points, and it is an object of the present invention to provide a refrigeration apparatus capable of making a defrosting operation less likely to be executed under the situation where a heating operation is easily continuously executed or it is considered that continuous execution of the heating operation is desired.

Solution to Problem

A refrigeration apparatus according to a first aspect includes a refrigerant circuit and a control unit. The refrigerant circuit includes a compressor, an outdoor heat exchanger, an expansion mechanism, and an indoor heat exchanger connected to each other. The refrigerant circuit is capable of executing at least a heating operation by circulating a refrigerant through the refrigerant circuit. The control unit is configured to start a defrosting operation when a first defrosting start condition is satisfied in a case where a predetermined premise situation is not established. The control unit is configured to start the defrosting operation when a second defrosting start condition is satisfied in a case where the predetermined premise situation is established. The defrosting operation is an operation for melting frost formed on the outdoor heat exchanger. The second defrosting start condition is stricter than the first defrosting start condition. The predetermined premise situation is at least either a situation relating to unlikelihood of formation of frost on the outdoor heat exchanger progressing or a situation where a load of the heating operation is large.

The condition that the second defrosting start condition is stricter than the first defrosting start condition means that the second defrosting start condition is less likely to be established than the first defrosting start condition. For example, each of the defrosting start conditions may be a set of a plurality of kinds of sub-conditions (the condition established when any one of the sub-conditions is satisfied). In this case, the first defrosting start condition and the second defrosting start condition may partially include the same sub-condition. The unlikelihood of the condition being established can be determined in a state in which the heating operation is performed in the refrigerant circuit.

Further, the situation relating to unlikelihood of formation of frost on the outdoor heat exchanger progressing includes both a situation where the formation of frost on the outdoor heat exchanger is less likely to progress and a situation where it is presumed that the formation of frost on the outdoor heat exchanger is less likely to progress.

In this refrigeration apparatus, in the case where the situation relating to unlikelihood of formation of frost on the outdoor heat exchanger progressing as the predetermined premise situation is established, frost is less likely to be formed on the outdoor heat exchanger or the degree of formation is low even when the heating operation is executed. Thus, it is possible to continuously execute the heating operation while preventing the execution of the defrosting operation. Further, in the case where the situation where the load of the heating operation is large as the predetermined premise situation is established, the temperature circumstance inside the room can be improved by executing the heating operation while preventing the execution of the defrosting operation.

A refrigeration apparatus according to a second aspect is the refrigeration apparatus according to the first aspect in which the predetermined premise situation is satisfied in at least any of the following cases: (1) a case where an elapsed time from a last stop of the compressor is equal to or longer than a predetermined elapsed time at a start of the heating operation; (2) a case where a time of day at the start of the heating operation satisfies a predetermined time of day condition; (3) a case where a temperature of the outdoor heat exchanger or a refrigerant pipe connected to the outdoor heat exchanger is equal to or higher than a predetermined temperature at the start of the heating operation; (4) a case where a difference between a set temperature and an indoor temperature is equal to or larger than a predetermined value at the start of the heating operation; and (5) a case where a state of the refrigerant in the refrigerant circuit satisfies a predetermined refrigerant state or the difference between the set temperature and the indoor temperature is equal to or larger than a predetermined value after an elapse of a predetermined period from the start of the heating operation.

The predetermined value of (4) and the predetermined value of (5) may either be equal to or be different from each other.

The temperature of the outdoor heat exchanger is not limited to any temperature, and may be the temperature in a part between the entrance and the exit of the refrigerant in the outdoor heat exchanger. Further, the temperature of the refrigerant pipe connected to the outdoor heat exchanger may either be the temperature of the refrigerant pipe directly connected to one side in the refrigerant flow of the outdoor heat exchanger or the temperature of the refrigerant pipe directly connected to the other side.

In a case where the heating operation is started in the early morning after a stopped state of the compressor has been continued for a long time or under the situation where the difference between the set temperature and the indoor temperature is large, there is a high possibility that a long time has elapsed from the stop of the compressor. Thus, even when frost is formed on the outdoor heat exchanger during the last operation of the compressor, there is a high possibility that the frost is melted by an elapse of some period of time from the stop of the compressor and the surface of the outdoor heat exchanger is dry. In the case where the heating operation is started with the surface of the outdoor heat exchanger dry in this manner, frost is less likely to be formed on the outdoor heat exchanger as compared to the case where the surface of the outdoor heat exchanger is wet such as the case where the defrosting operation is performed after the start of the heating operation and a return to the heating operation is made again. Thus, in such a case, the heating operation is easily continuously executed.

In the case where the elapsed time from the last stop of the compressor is equal to or longer than the predetermined elapsed time at the start of the heating operation, it is presumed that the surface of the outdoor heat exchanger is dry. Thus, even when the heating operation is continuously executed by setting the start condition of the defrosting operation to a stricter condition, it is possible to prevent a rise in a pressure loss of air passing through the outdoor heat exchanger caused by frost formation to facilitate ensuring a sufficient evaporation capacity of the outdoor heat exchanger. Further, in the case where the elapsed time from the last stop of the compressor is equal to or longer than the predetermined elapsed time, the indoor temperature tends to drop, and the degree of difference from the set temperature tends to increase. Thus, it can be presumed that a user feels cold. Under such a situation where it can be considered that a user wants to continue the heating operation, it is possible to raise the indoor temperature by continuously executing the heating operation while preventing the defrosting operation.

Further, in the case where the time of day at the start of the heating operation satisfies the predetermined time of day condition, for example, the case where the early morning time period is set as the predetermined time of day condition in a use mode in which the operation is stopped in the middle of the night and started in the early morning, it is presumed that the surface of the outdoor heat exchanger is dry. Thus, even when the start condition of the defrosting operation is set stricter to continuously execute the heating operation, it is possible to prevent a rise in the pressure loss of air passing through the outdoor heat exchanger to facilitate ensuring a sufficient evaporation capacity of the outdoor heat exchanger. Further, in a case where a time period such as the early morning in which the outside air temperature tends to drop is set as the predetermined time of day condition, the indoor temperature tends to drop and the degree of difference from the set temperature tends to increase. Thus, it can be presumed that a user feels cold. Under such a situation where it can be considered that a user wants to continue the heating operation, it is possible to raise the indoor temperature by continuously executing the heating operation while preventing the defrosting operation.

Further, in the case where the temperature of the outdoor heat exchanger or the refrigerant pipe connected to the outdoor heat exchanger is equal to or higher than the predetermined temperature at the start of the heating operation, it can be presumed that the temperature of the outdoor heat exchanger or the like has risen, for example, up to approximately the ambient temperature due to an elapse of a long time from when the temperature of the outdoor heat exchanger is in a dropped state because the compressor is driven and the outdoor heat exchanger functions as the evaporator for the refrigerant, and the surface of the outdoor heat exchanger is dry. Thus, even when the start condition of the defrosting operation is set stricter to continuously execute the heating operation, it is possible to prevent a rise in the pressure loss of air passing through the outdoor heat exchanger caused by frost formation to facilitate ensuring a sufficient evaporation capacity of the outdoor heat exchanger. Further, in the case where the temperature of the outdoor heat exchanger or the refrigerant pipe connected to the outdoor heat exchanger is equal to or higher than the predetermined temperature, the indoor temperature tends to drop and the degree of difference from the set temperature tends to increase due to an elapse of a long time from the last stop of the compressor. Thus, it can be presumed that a user feels cold. Under such a situation where it can be considered that a user wants to continue the heating operation, it is possible to raise the indoor temperature by continuously executing the heating operation while preventing the defrosting operation.

Further, in the case where the difference between the set temperature and the indoor temperature is equal to or larger than the predetermined value at the start of the heating operation, it can be presumed that a user feels cold. Under such a situation where it can be considered that a user wants to continue the heating operation, it is possible to raise the indoor temperature by continuously executing the heating operation while preventing the defrosting operation.

Further, in the case where the state of the refrigerant in the refrigerant circuit satisfies the predetermined refrigerant state after an elapse of the predetermined period from the start of the heating operation, for example, the case where a superheating degree of the discharged refrigerant is not equal to or higher than a predetermined value even after an elapse of the predetermined period from the start of the heating operation, it can be presumed that the refrigerant is melted and retained in a refrigerating machine oil. Further, it can also be presumed that the surface of the outdoor heat exchanger is dry. Thus, even when the start condition of the defrosting operation is set stricter to continuously execute the heating operation, it is possible to prevent a rise in the pressure loss of air passing through the outdoor heat exchanger caused by frost formation to facilitate ensuring a sufficient evaporation capacity of the outdoor heat exchanger. Further, in the case where the state of the refrigerant in the refrigerant circuit satisfies the predetermined refrigerant state after an elapse of the predetermined period from the start of the heating operation, it can be presumed that the indoor temperature cannot be raised, and a user feels cold. Under the situation where a user wants to continue the heating operation, it is possible to raise the indoor temperature by continuously executing the heating operation while preventing the defrosting operation.

Further, in the case where the difference between the set temperature and the indoor temperature is equal to or larger than the predetermined value after an elapse of the predetermined period from the start of the heating operation, it can be presumed that the indoor temperature has not sufficiently risen even after performing the heating operation for a while, and a user feels cold. Under such a situation where a user wants to continue the heating operation, it is possible to raise the indoor temperature by continuously executing the heating operation while preventing the defrosting operation.

As described above, this refrigeration apparatus makes it possible to make the defrosting operation less likely to be executed under the situation where the heating operation is easily continuously executed or it is considered that continuous execution of the heating operation is desired.

A refrigeration apparatus according to a third aspect is the refrigeration apparatus according to the first or second aspect in which the control unit does not start the defrosting operation during the heating operation, but forcibly starts the defrosting operation regardless of whether the second defrosting start condition is satisfied or starts the defrosting operation when the first defrosting start condition is satisfied in any of the following cases (a), (b), (c):

(a) a case where a heating capacity satisfies a predetermined capacity reduction condition;

(b) a case where a predetermined reliability condition relating to a reliability of the compressor is satisfied; and (c) a case where a load of the heating operation satisfies a predetermined low-load condition.

Although the predetermined reliability condition relating to the reliability of the compressor is not limited to any condition, the predetermined reliability condition may be, for example, a condition which is satisfied under the situation where the superheating degree of the refrigerant sucked into the compressor or the superheating degree of the refrigerant discharged from the compressor becomes equal to or lower than a predetermined value and the liquid refrigerant may be sucked into the compressor (note that the predetermined value described herein may also either be equal to or be different from each predetermined value described in (4), (5) of the refrigeration apparatus according to the second aspect).

Further, although the case where the low-load condition is satisfied is not limited to any case, the case where the low-load condition is satisfied includes a case where the difference between the indoor temperature and the set temperature becomes equal to or smaller than a predetermined value and a case where the indoor temperature reaches the set temperature and the compressor is thus stopped (note that the predetermined value described herein may also either be equal to or be different from each predetermined value described in (4), (5) of the refrigeration apparatus according to the second aspect or the predetermined value relating to the predetermined reliability condition of the refrigeration apparatus according to the third aspect).

In this refrigeration apparatus, the defrosting operation is forcibly started in any of the above cases (a), (b), (c) or the defrosting operation is started when the first defrosting start condition is satisfied in both the case where the predetermined premise situation is established and the case where the predetermined premise situation is not established. That is, in this refrigeration apparatus, between the case where the predetermined premise situation is established and the case where the predetermined premise situation is not established, the strictness of the condition is the same in any of the above conditions (a), (b), (c) relating to the start of the defrosting operation and differs in the other conditions. For example, a case where the heating capacity does not satisfies the predetermined capacity reduction condition (the above (a) is not established) on the condition that the defrosting operation is started when the temperature of the outdoor heat exchanger becomes equal to or lower than the predetermined value in the case (a) where the heating capacity satisfies the predetermined capacity reduction condition in both the case where the predetermined premise situation is established and the case where the predetermined premise situation is not established includes a case where "a threshold of the temperature of the outdoor heat exchanger in the defrosting start condition in the case where the predetermined premise situation is established" is set lower than "a threshold of the temperature of the outdoor heat exchanger in the case where the predetermined premise situation is not established".

In the refrigeration apparatus to which (a) is applied, in the case where the predetermined premise situation is established, but the heating capacity is reduced by frost formed on the outdoor heat exchanger due to a continuous heating operation and the predetermined capacity reduction condition is thereby satisfied, the defrosting operation is forcibly started or the condition is changed to the first defrosting start condition which is more easily satisfied to facilitate the start of the defrosting operation. Accordingly, even in the case where the predetermined premise situation is established, it is possible to prevent an excessive reduction in the heating capacity.

Further, in the refrigeration apparatus to which (b) is applied, in the case where the predetermined premise situation is established, but the superheating degree of the refrigerant sucked into the compressor or the refrigerant discharged from the compressor is reduced and the predetermined reliability condition relating to the reliability of the compressor is thereby satisfied, the defrosting operation is forcibly started or the condition is changed to the first defrosting start condition which is more easily satisfied to facilitate the start of the defrosting operation. Accordingly, even in the case where the predetermined premise situation is established, it is possible to facilitate ensuring a sufficient reliability of the compressor.

Further, in the refrigeration apparatus to which (c) is applied, in the case where the predetermined premise situation is established, but the load of the heating operation is small and satisfies the predetermined low-load condition, the defrosting operation is forcibly started or the condition is changed to the first defrosting start condition which is more easily satisfied to facilitate the start of the defrosting operation. Accordingly, under the situation where a user is less likely to feel cold such as the situation where the load of the heating operation is small, even in the case where the predetermined premise situation is established, it is possible improve the evaporation capacity of the outdoor heat exchanger by facilitating the execution of the defrosting operation.

As described above, this refrigeration apparatus makes it possible to improve at least any of a reduction in the heating capacity, a reduction in the reliability of the compressor, and a reduction in the evaporation capacity of the outdoor heat exchanger as troubles that may occur due to excessive continuation of the heating operation without the defrosting operation.

A refrigeration apparatus according to a fourth aspect is the refrigeration apparatus according to the third aspect in which the case where the heating capacity satisfies the predetermined capacity reduction condition is at least any of the following cases (a1), (a2), (a3):

(a1) a case where a condensation temperature of the refrigerant in the indoor heat exchanger is equal to or lower than a predetermined temperature;

(a2) a case where a temperature of air that has passed through the indoor heat exchanger is equal to or lower than a predetermined temperature; and (a3) a case where the first defrosting start condition includes a condition that a temperature of the outdoor heat exchanger or a refrigerant pipe connecting the outdoor heat exchanger and the expansion mechanism is equal to or lower than a predetermined reference temperature, and a predetermined time elapses with the temperature of the outdoor heat exchanger or the refrigerant pipe connecting the outdoor heat exchanger and the expansion mechanism maintained equal to or lower than the predetermined reference temperature.

A method for specifying the condensation temperature of the refrigerant in the indoor heat exchanger is not limited any method. A saturation temperature corresponding to the pressure of the refrigerant on the suction side of the compressor in the heating operation may be estimated and used as the condensation temperature or the temperature of the refrigerant flowing through an intermediate part of the indoor heat exchanger in the heating operation may be estimated and used as the condensation temperature.

The predetermined temperatures in (a1), (a2) may either be equal to or be different from each other, or may either be equal to or be different from the predetermined temperature described in (3) of the refrigeration apparatus according to the second aspect.

In this refrigeration apparatus, in the above cases (a1), (a2), (a3), it can be estimated that the evaporation capacity of the outdoor heat exchanger is reduced by frost formed on the outdoor heat exchanger due to excessive continuation of the heating operation without the defrosting operation, which results in the heating capacity in a reduced state. Thus, the reduction in the heating capacity can be improved by forcibly starting the defrosting operation or relaxing the condition so as to facilitate the execution of the defrosting operation based on the estimation.

A refrigeration apparatus according to a fifth aspect is the refrigeration apparatus according to any one of the first to fourth aspects in which the first defrosting start condition includes a condition that a temperature of the outdoor heat exchanger or a refrigerant pipe connecting the outdoor heat exchanger and the expansion mechanism is equal to or lower than a predetermined first temperature. The second defrosting start condition includes a condition that the temperature of the outdoor heat exchanger or the refrigerant pipe connecting the outdoor heat exchanger and the expansion mechanism is equal to or lower than a predetermined second temperature lower than the first temperature.

The first temperature may either be equal to or be different from the reference temperature described in the refrigeration apparatus according to the fourth aspect.

This refrigeration apparatus makes it possible to determine the start of the defrosting operation using a value from which the frost formation amount in the outdoor heat exchanger can be directly grasped, namely the temperature of the outdoor heat exchanger or the refrigerant pipe which connects the outdoor heat exchanger and the expansion mechanism.

Advantageous Effects of Invention

The refrigeration apparatus according to the first aspect makes it possible to continuously execute the heating operation while preventing the execution of the defrosting operation or process a larger heating load by executing the heating operation while preventing the execution of the defrosting operation under the situation where the defrosting operation can be prevented.

The refrigeration apparatus according to the second aspect makes it possible to make the defrosting operation less likely to be executed under the situation where the heating operation is easily continuously executed or it is considered that continuous execution of the heating operation is desired.

The refrigeration apparatus according to the third aspect makes it possible to improve at least any of a reduction in the heating capacity, a reduction in the reliability of the compressor, and a reduction in the evaporation capacity of the outdoor heat exchanger as troubles that may occur due to excessive continuation of the heating operation without the defrosting operation.

The refrigeration apparatus according to the fourth aspect makes it possible to improve a reduction in the heating capacity based on the estimation that the heating capacity is in a reduced state.

The refrigeration apparatus according to the fifth aspect makes it possible to determine the start of the defrosting operation using a value from which the frost formation amount in the outdoor heat exchanger can be directly grasped.

DESCRIPTION OF EMBODIMENTS

Hereinbelow, an embodiment of an air conditioning apparatus as a refrigeration apparatus according to the present invention and modifications thereof will be described with reference to the drawings. The detailed configuration of the air conditioning apparatus as the refrigeration apparatus according to the present invention is not limited to the embodiment and modifications described below, and can be changed without departing from the gist of the invention.

(1) Configuration of Air Conditioning Apparatus

Figure 1:
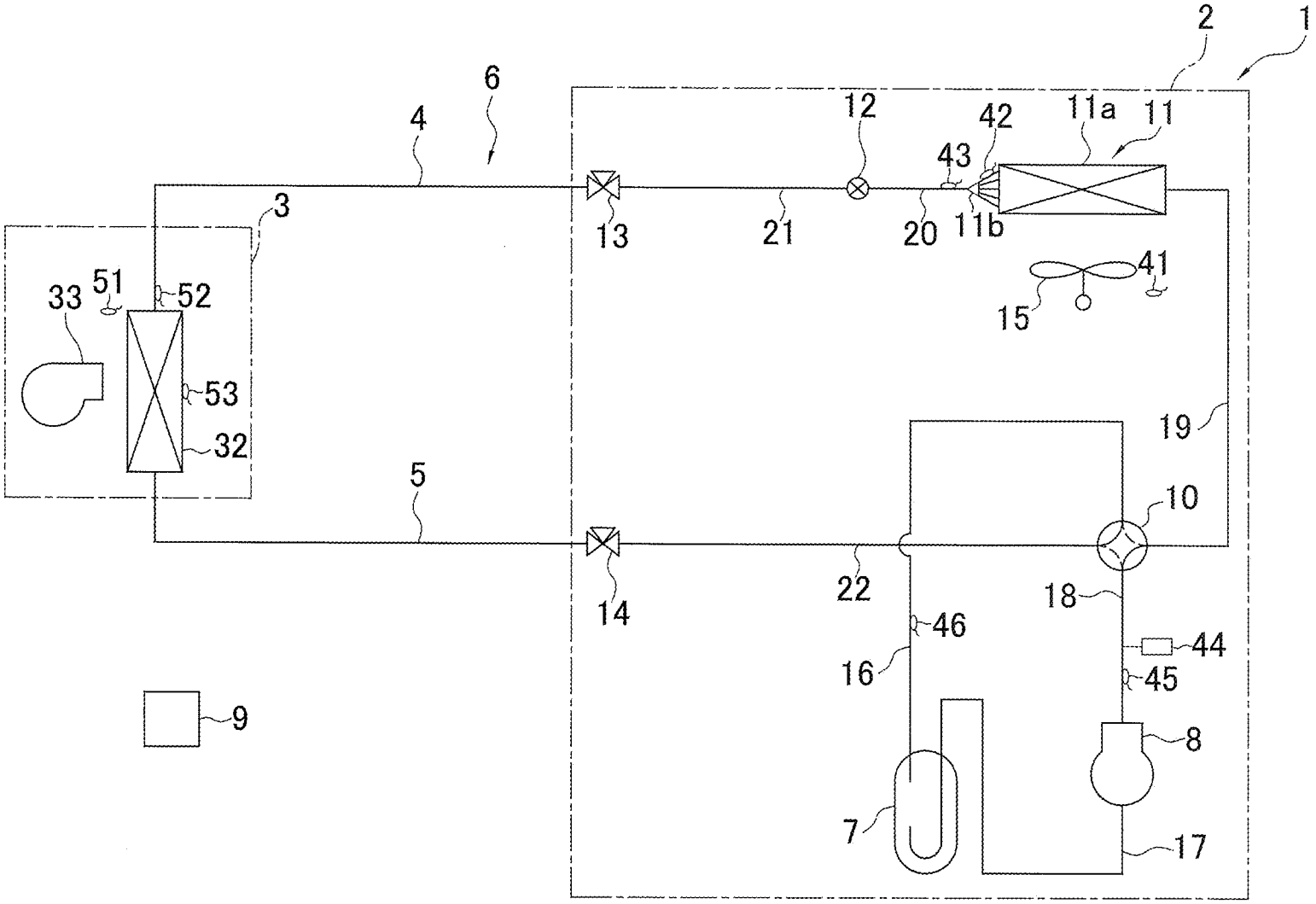
FIG. 1 is a schematic configuration diagram of an air conditioning apparatus according to an embodiment of the present invention.
Figure 2:
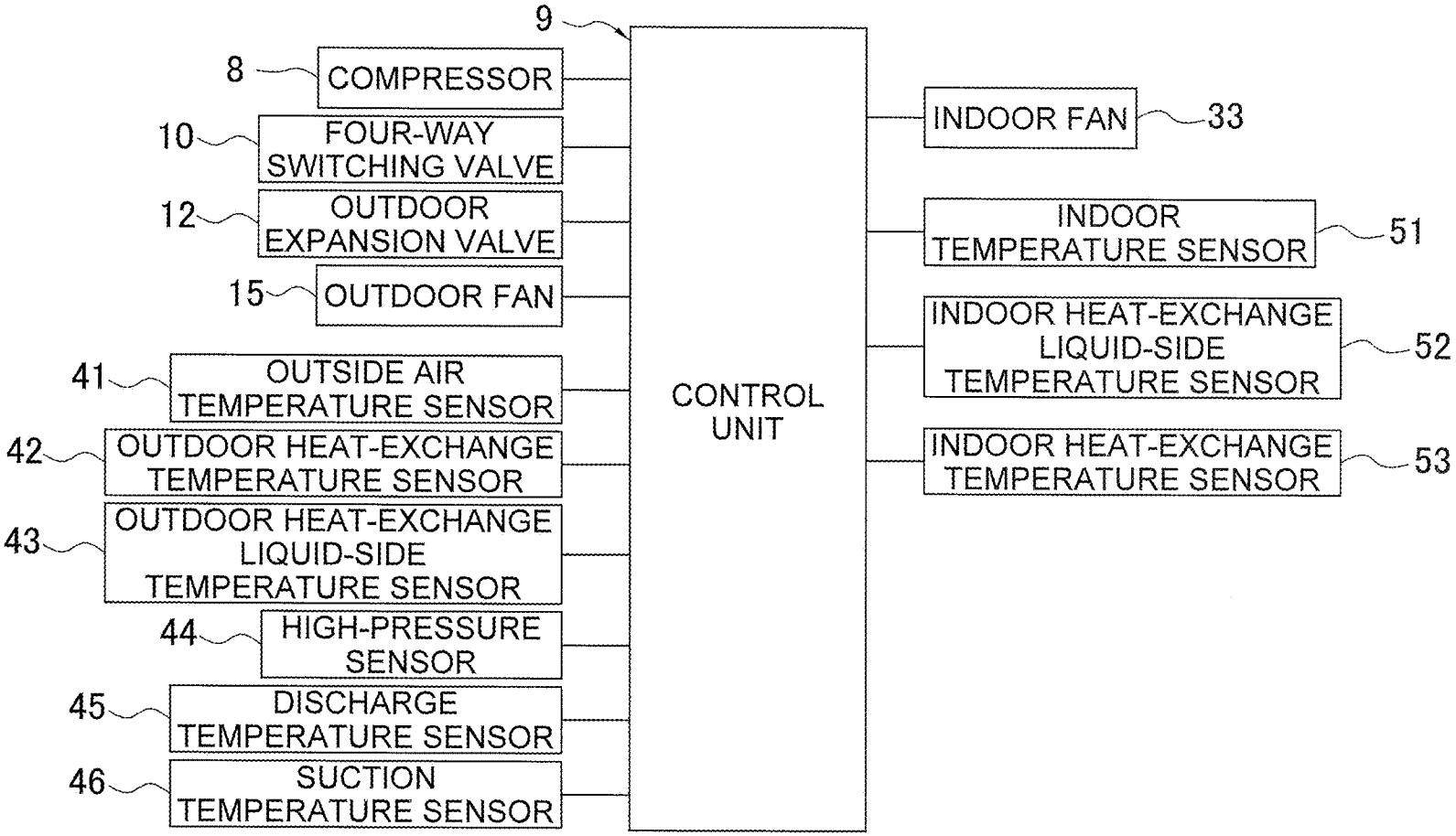
FIG. 2 is a block configuration diagram of the air conditioning apparatus.

FIG. 1 is a schematic configuration diagram of an air conditioning apparatus 1 as a refrigeration apparatus according to an embodiment of the present invention. FIG. 2 is a block configuration diagram of the air conditioning apparatus 1.

The air conditioning apparatus 1 is an apparatus capable of performing cooling and heating inside a room of a building or the like by preforming a vapor compression refrigeration cycle.

The air conditioning apparatus 1 mainly includes an outdoor unit 2, an indoor unit 3, a liquid-refrigerant connection pipe 4 and a gas-refrigerant connection pipe 5 which connect the outdoor unit 2 and the indoor unit 3, and a control unit 9 which controls constituent devices of the outdoor unit 2 and the indoor unit 3. A vapor compression refrigerant circuit 6 of the air conditioning apparatus 1 includes the outdoor unit 2 and the indoor unit 3 which are connected through the refrigerant connection pipes 4, 5. In the present embodiment, the refrigerant circuit 6 is filled with R32 as a working refrigerant, but the working refrigerant is not limited to R32.

The outdoor unit 2 is installed outside the room (on the roof of the building or near a wall surface of the building), and constitutes a part of the refrigerant circuit 6. The outdoor unit 2 mainly includes an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15.

The outdoor heat exchanger 11 includes a heat exchanger main body and a flow divider 11*a* which includes a plurality of flow dividing pipes on the liquid side of the heat exchanger main body.

The devices and valves are connected through refrigerant pipes 16 to 22.

Specifically, an accumulator suction-side pipe 16 connects a first connection port of the four-way switching valve 10 and the accumulator 7. A suction pipe 17 connects the accumulator 7 and the suction side of the compressor 8. A discharge pipe 18 connects the discharge side of the compressor 8 and a second connection port of the four-way switching valve 10. An outdoor heat-exchange gas-side pipe 19 connects a third connection port of the four-way switching valve 10 and the gas side of the outdoor heat exchanger 11. An outdoor heat-exchange liquid-side pipe 20 connects the liquid side of the outdoor heat exchanger 11 and the outdoor expansion valve 12. An outdoor liquid-side connection pipe 21 connects the outdoor expansion valve 12 and the liquid-side shutoff valve 13. An outdoor gas-side connection pipe 22 connects the gas-side shutoff valve 14 and a fourth connection port of the four-way switching valve 10.

The outdoor unit 2 is provided with various sensors 41 to 46. Specifically, an outside air temperature sensor 41 detects the temperature of outdoor air before the air passes through the outdoor heat exchanger 11. An outdoor heat-exchange temperature sensor 42 is attached to one of the flow dividing pipes included in the flow divider 11*a* of the outdoor heat exchanger 11, and detects the temperature of the refrigerant flowing through the liquid side of the heat exchanger main body in the outdoor heat exchanger 11. An outdoor heat-exchange liquid-side temperature sensor 43 is attached to the outdoor heat-exchange liquid-side pipe 20, and detects the temperature of the refrigerant flowing between the flow divider 11*a* of the outdoor heat exchanger 11 and the outdoor expansion valve 12. A discharge pressure sensor 44 is attached to the discharge pipe 18, and detects the pressure of the refrigerant discharged from the compressor 8 (high pressure in the refrigeration cycle). A discharge temperature sensor 45 is attached to the discharge pipe 18, and detects the temperature of the refrigerant discharged from the compressor 8. A suction temperature sensor 46 is attached to the accumulator suction-side pipe 16, and detects the temperature of the refrigerant sucked into the compressor 8 (the temperature of the low-pressure refrigerant in the refrigeration cycle).

The indoor unit 3 is installed inside the room (in a living room or in a ceiling space), and constitutes a part of the refrigerant circuit 6. The indoor unit 3 mainly includes an indoor heat exchanger 32 and the indoor fan 33.

The indoor unit 3 is provided with various sensors 51 to 53. Specifically, an indoor air temperature sensor 51 detects the temperature of indoor air before the air passes through the indoor heat exchanger 32. An indoor heat-exchange liquid-side temperature sensor 52 detects the temperature of the refrigerant flowing through the liquid side of the indoor heat exchanger 32. An indoor heat-exchange temperature sensor 53 is attached to the indoor heat exchanger 32, and detects the temperature of the refrigerant flowing through an intermediate part in the refrigerant flow of the indoor heat exchanger 32.

The refrigerant connection pipes 4, 5 are refrigerant pipes constructed in a site where the air conditioning apparatus 1 is installed in an installation place such as a building. One end of the liquid-refrigerant connection pipe 4 is connected to the liquid-side shutoff valve 13 of the outdoor unit 2, and the other end of the liquid-refrigerant connection pipe 4 is connected to the liquid side of the indoor heat exchanger 32 of the indoor unit 3. One end of the gas-refrigerant connection pipe 5 is connected to the gas-side shutoff valve 14 of the outdoor unit 2, and the other end of the gas-refrigerant connection pipe 5 is connected to the gas side of the indoor heat exchanger 32 of the indoor unit 3.

Control boards (not illustrated) included in the outdoor unit 2 and the indoor unit 3 are communicably connected to the control unit 9. The control unit 9 is connected to each of the sensors 51 to 53 and 41 to 46, and controls the constituent devices 8, 10, 12, 15, 33 of the air conditioning apparatus 1 (in the present embodiment, the outdoor unit 2 and the indoor unit 3), that is, controls the operation of the entire air conditioning apparatus 1 in accordance with detection values of these sensors or a command from a remote controller (not illustrated). The control unit 9 includes one or more CPUs, a ROM, and a RAM. The control unit 9 executes control programs stored in the ROM in accordance with information obtained from each of the sensors 51 to 53 and 41 to 46 or a command from the remote controller to perform various control operations. The control unit 9 has a timer function for grasping an elapsed time.

(2) Operation of Air Conditioning Apparatus

Next, the operation of the air conditioning apparatus 1 will be described with reference to FIG. 1. The air conditioning apparatus 1 performs a cooling operation which circulates the refrigerant through the compressor 8, the outdoor heat exchanger 11, the outdoor expansion valve 12, and the indoor heat exchanger 32 in this order and a heating operation which circulates the refrigerant through the compressor 8, the indoor heat exchanger 32, the outdoor expansion valve 12, and the outdoor heat exchanger 11 in this order. The cooling operation and the heating operation are performed by the control unit 9.

(2-1) Cooling Operation

In the cooling operation, the connection state of the four-way switching valve 10 is switched so that the outdoor heat exchanger 11 serves as a radiator for the refrigerant (refer to a solid line in FIG. 1). In the refrigerant circuit 6, a low-pressure gas refrigerant of the refrigeration cycle is sucked into the compressor 8, compressed until the refrigerant becomes a high pressure of the refrigeration cycle, and then discharged. The high-pressure gas refrigerant discharged from the compressor 8 is fed to the outdoor heat exchanger 11 through the four-way switching valve 10. The high-pressure gas refrigerant fed to the outdoor heat exchanger 11 dissipates heat by exchanging heat with outdoor air which is supplied as a cooling source by the outdoor fan 15 to become a high-pressure liquid refrigerant in the outdoor heat exchanger 11 which functions as the radiator for the refrigerant. The high-pressure liquid refrigerant is decompressed until the refrigerant becomes a low pressure of the refrigeration cycle while passing through the outdoor expansion valve 12 to become a refrigerant in a gas-liquid two-phase state. The refrigerant in a gas-liquid two-phase state is fed to the indoor unit 3 through the liquid-side shutoff valve 13 and the liquid-refrigerant connection pipe 4.

The low-pressure refrigerant in a gas-liquid two-phase state evaporates by exchanging heat with indoor air which is supplied as a heating source by the indoor fan 33 in the indoor heat exchanger 32. Accordingly, the air passing through the indoor heat exchanger 32 is cooled, thereby cooling the inside of the room. The low-pressure gas refrigerant evaporated in the indoor heat exchanger 32 is fed to the outdoor unit 2 through the gas-refrigerant connection pipe 5.

The low-pressure gas refrigerant fed to the outdoor unit 2 is sucked into the compressor 8 again through the gas-side shutoff valve 14, the four-way switching valve 10, and the accumulator 7. In the cooling operation, the refrigerant circulates through the refrigerant circuit 6 as described above.

(2-2) Heating Operation

In the heating operation, the connection state of the four-way switching valve 10 is switched so that the outdoor heat exchanger 11 serves as an evaporator for the refrigerant (refer to a broken line in FIG. 1). In the refrigerant circuit 6, a low-pressure gas refrigerant of the refrigeration cycle is sucked into the compressor 8, compressed until the refrigerant becomes a high pressure of the refrigeration cycle, and then discharged. The high-pressure gas refrigerant discharged from the compressor 8 is fed to the indoor unit 3 through the four-way switching valve 10, the gas-side shutoff valve 14, and the gas-refrigerant connection pipe 5.

The high-pressure gas refrigerant dissipates heat by exchanging heat with indoor air which is supplied as a cooling source by the indoor fan 33 to become a high-pressure liquid refrigerant in the indoor heat exchanger 32. Accordingly, the air passing through the indoor heat exchanger 32 is heated, thereby heating the inside of the room. The high-pressure liquid refrigerant with heat dissipated in the indoor heat exchanger 32 is fed to the outdoor unit 2 through the liquid-refrigerant connection pipe 4.

The high-pressure liquid refrigerant fed to the outdoor unit 2 is decompressed to a low pressure of the refrigeration cycle by the outdoor expansion valve 12 through the liquid-side shutoff valve 13 to become a low-pressure refrigerant in a gas-liquid two-phase state. The low-pressure refrigerant in a gas-liquid two-phase state decompressed by the outdoor expansion valve 12 evaporates by exchanging heat with outdoor air which is supplied as a heating source by the outdoor fan 15 to become a low-pressure gas refrigerant in the outdoor heat exchanger 11 which functions as the evaporator for the refrigerant. The low-pressure gas refrigerant is sucked into the compressor 8 again through the four-way switching valve 10 and the accumulator 7. In the heating operation, the refrigerant circulates through the refrigerant circuit 6 as described above.

(2-3) Defrosting Operation

The air conditioning apparatus 1 performs a defrosting operation for melting frost formed on the outdoor heat exchanger 11 when the heating operation is performed.

The defrosting operation is performed in a case where a defrosting start condition is satisfied when the heating operation is performed. When the defrosting start condition is satisfied, the air conditioning apparatus 1 switches the connection state of the four-way switching valve 10 so that the discharge side of the compressor 8 is connected to the gas side of the outdoor heat exchanger 11 and drives the compressor 8 to cause the outdoor heat exchanger 11 to function as the radiator for the refrigerant, thereby melting frost formed on the outdoor heat exchanger 11.

The defrosting operation ends by satisfying a defrosting end condition. Accordingly, the connection state of the four-way switching valve 10 is switched so that the outdoor heat exchanger 11 serves as the evaporator for the refrigerant to resume the heating operation. The defrosting end condition is the condition that the temperature detected by the outdoor heat-exchange temperature sensor 42 becomes equal to or higher than a predetermined defrosting end temperature or the condition that a predetermined defrosting duration time elapses from the start of the defrosting operation.

(3) Defrosting Start Condition

In the air conditioning apparatus 1 of the present embodiment, different defrosting start conditions can be applied according to a predetermined premise situation (described later). Specifically, the air conditioning apparatus 1 is switched between a mode in which the defrosting start condition corresponding to the predetermined premise situation is applied and a mode in which the defrosting start condition is applied regardless of the predetermined premise situation by changing setting in a remote controller (not illustrated) or the like. Hereinbelow, the case where the air conditioning apparatus 1 is set to the mode in which different defrosting start conditions are applied according to the predetermined premise situation will be described.

The defrosting operation is started when a first defrosting start condition is satisfied under a situation where the predetermined premise situation is not established and started when a second defrosting start condition is satisfied under a situation where the predetermined premise situation is established. The second defrosting start condition is stricter than the first defrosting start condition and less likely to be satisfied during the heating operation. The first defrosting start condition is determined to be satisfied in a case where the outside air temperature detected by the outside air temperature sensor 41 is equal to or lower than a predetermined outside air temperature (e.g., 0° C.) and the outdoor heat-exchange temperature detected by the outdoor heat-exchange temperature sensor 42 is equal to or lower than a first defrosting determination value (the reference temperature, the first temperature). Although the first defrosting determination value is not limited to any value, the first defrosting determination value may be, for example, −10° C.

The second defrosting start condition is determined to be satisfied in a case where the outside air temperature detected by the outside air temperature sensor 41 is equal to or lower than the predetermined outside air temperature (e.g., 0° C.), and the outdoor heat-exchange temperature detected by the outdoor heat-exchange temperature sensor 42 is equal to or lower than a second defrosting determination value (the second temperature). Although the second defrosting determination value is not limited to any value, the second defrosting determination value may be, for example, −20° C. Since the second defrosting determination value is lower than the first defrosting determination value, it can be said that the second defrosting start condition is stricter than the first defrosting start condition.

The detection value of the outdoor heat-exchange temperature sensor 42, which detects the temperature of the refrigerant flowing through the outdoor heat exchanger 11, is used in the determination of the defrosting start condition in this manner. Thus, it is possible to more directly (e.g., more directly than in the case where an operation time from the start of the heating operation is used) grasp the amount of frost formed on the outdoor heat exchanger 11.

The defrosting end condition is the same between the case where the defrosting operation is started by satisfying the first defrosting start condition and the case where the defrosting operation is started by satisfying the second defrosting start condition.

(4) Application of First and Second Defrosting Start Conditions According to Predetermined Premise Situation In the air conditioning apparatus 1 of the present embodiment, the first defrosting start condition is used as the condition for starting the defrosting operation in the case where the predetermined premise situation is not established, and the second defrosting start condition, which is stricter than the first defrosting start condition, is used as the condition for starting the defrosting operation in the case where the predetermined premise situation is established.

In the present embodiment, the predetermined premise situation is the situation which is determined to be satisfied in a case where an elapsed time from the last stop of the compressor 8 is equal to or longer than a predetermined elapsed time at the start of the heating operation. The control unit 9 determines whether the predetermined premise situation is established. Although the length of the predetermined elapsed time is not limited to any length, the length of the predetermined elapsed time is preferably, for example, three hours or longer.

Figure 3:
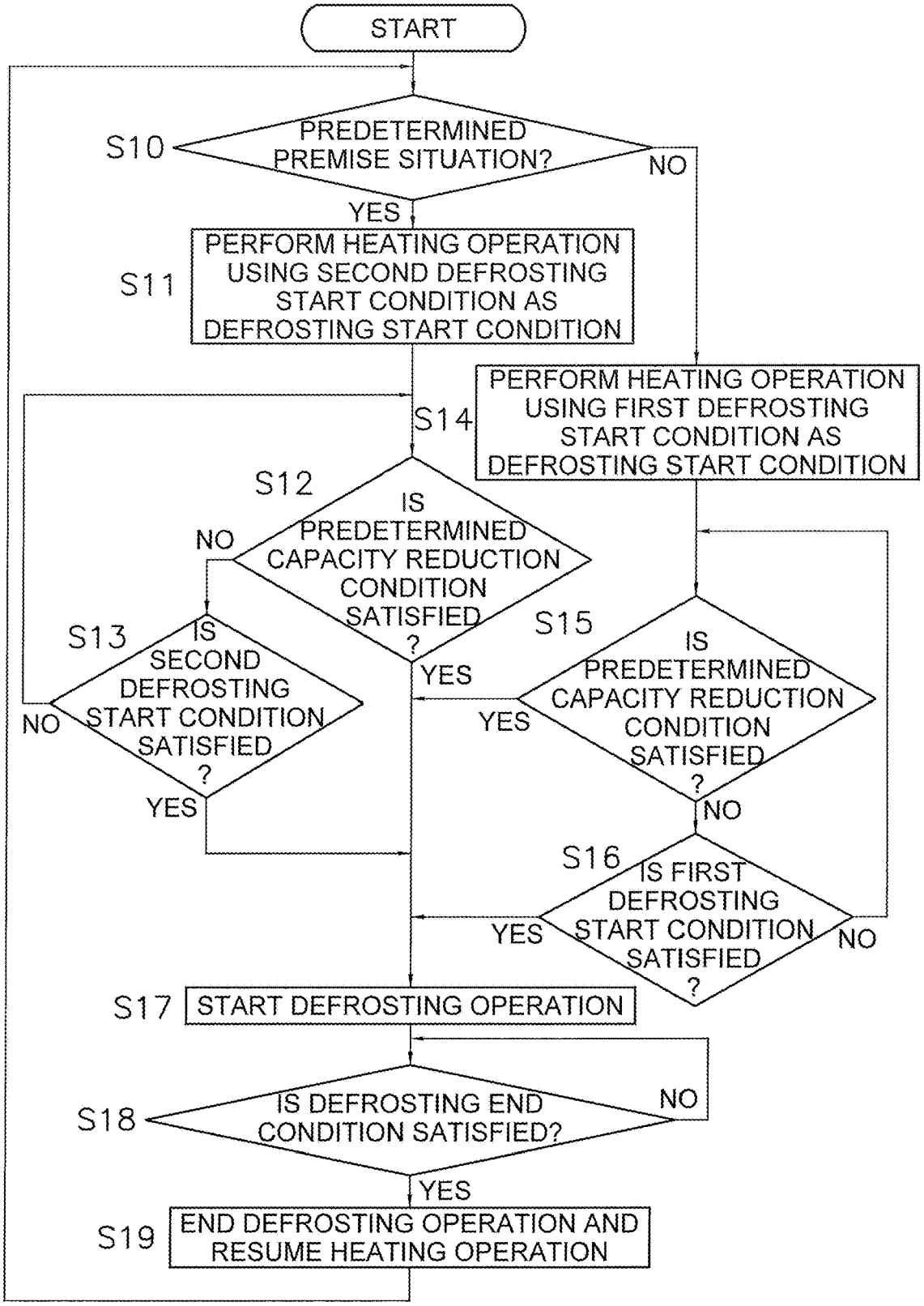
FIG. 3 is a control flowchart relating to a defrosting operation.

(5) Control Flow of Defrosting Operation According to Defrosting Start Condition FIG. 3 illustrates a control flowchart relating to the heating operation and the defrosting operation. Hereinbelow, the flowchart in the case where the setting of the air conditioning apparatus 1 is set to the mode in which different defrosting start conditions are applied according to the predetermined premise situation will be described.

In step S10, the control unit 9 determines whether the predetermined premise situation is established. Specifically, the control unit 9 determines that the predetermined premise situation is established in a case where the compressor 8 has been in a stopped state for a predetermined elapsed time (e.g., five hours) or longer and determines that the predetermined premise situation is not established in a case where the compressor 8 has been driven within the predetermined elapsed time. When it is determined that the predetermined premise situation is established, the process shifts to step S11. On the other hand, when it is determined that the predetermined premise situation is not established, the process shifts to step S14.

In step S11, the control unit 9 performs the heating operation using the second defrosting start condition, which is stricter than the first defrosting start condition, as the defrosting start condition. At this time, the heating operation is started from a stopped state of the air conditioning apparatus 1.

In step S12, the control unit 9 determines whether a predetermined capacity reduction condition is satisfied. Specifically, the control unit 9 determines that the predetermined capacity reduction condition is satisfied in a case where the condensation temperature of the refrigerant detected by the indoor heat-exchange temperature sensor 53 disposed on the indoor heat exchanger 32 is equal to or lower than a predetermined capacity ensuring temperature. Although the predetermined capacity ensuring temperature is not limited to any temperature, the predetermined capacity ensuring temperature may be, for example, a predetermined temperature required for heating the inside of the room as the condensation temperature of the refrigerant in the indoor heat exchanger 32 which functions as the condenser for the refrigeration. When it is determined that the predetermined capacity reduction condition is satisfied, the process shifts to step S17. On the other hand, when the predetermined capacity reduction condition is not satisfied, the process shifts to step S13.

In step S13, the control unit 9 determines whether the second defrosting start condition is satisfied. Specifically, the control unit 9 determines that the second defrosting start condition is satisfied in a case where the outside air temperature detected by the outside air temperature sensor 41 is equal to or lower than the predetermined outside air temperature (e.g., 0° C.) and the outdoor heat-exchange temperature detected by the outdoor heat-exchange temperature sensor 42 is equal to or lower than the second defrosting determination value (e.g., −20° C.). The second defrosting determination value is lower than the first defrosting determination value. When it is determined that the second defrosting start condition is satisfied, the process shifts to step S17. On the other hand, when it is determined that the second defrosting start condition is not satisfied, the process returns to step S12.

In step S14, the control unit 9 performs the heating operation using the first defrosting start condition, which is looser than the second defrosting start condition, as the defrosting start condition. At this time, in a case where the air conditioning apparatus 1 is in a stopped state, the heating operation is started. On the other hand, in a case where a return from the defrosting operation to the heating operation is made, the heating operation is continued.

In step S15, the control unit 9 determines whether the predetermined capacity reduction condition is satisfied. Specifically, the determination in step S15 is the same as the determination in step S12. The control unit 9 determines that the predetermined capacity reduction condition is satisfied in the case where the temperature detected by the indoor heat-exchange temperature sensor 53 disposed on the indoor heat exchanger 32 is equal to or lower than the predetermined capacity ensuring temperature. When it is determined that the predetermined capacity reduction condition is satisfied, the process shifts to step S17. On the other hand, when it is determined that the predetermined capacity reduction condition is not satisfied, the process shifts to step S16.

In step S16, the control unit 9 determines whether the first defrosting start condition is satisfied. Specifically, the control unit 9 determines that the first defrosting start condition is satisfied in the case where the outside air temperature detected by the outside air temperature sensor 41 is equal to or lower than the predetermined outside air temperature (e.g., 0° C.) and the outdoor heat-exchange temperature detected by the outdoor heat-exchange temperature sensor 42 is equal to or lower than the first defrosting determination value (e.g., −10° C.). The first defrosting determination value is higher than the second defrosting determination value. When it is determined that the first defrosting start condition is satisfied, the process shifts to step S17. On the other hand, when it is determined that the first defrosting start condition is not satisfied, the process returns to step S15.

In step S17, the control unit 9 suspends the heating operation and changes the connection state of the four-way switching valve 10 to cause the outdoor heat exchanger 11 to function as the radiator for the refrigerant, thereby starting the defrosting operation. Accordingly, it is possible to melt frost formed on the surface of the outdoor heat exchanger 11.

In step S18, the control unit 9 determines whether the defrosting end condition is satisfied. Specifically, the control unit 9 determines that the defrosting end condition is satisfied in the case where the temperature detected by the outdoor heat-exchange temperature sensor 42 is equal to or higher than the predetermined defrosting end temperature or in the case where the predetermined defrosting duration time elapses from the start of the defrosting operation. The control unit 9 grasps the duration time of the defrosting operation from a point in time when the defrosting operation is started in step S17 using the timer function and uses the duration time in the determination of the defrosting end condition. When it is determined that the defrosting end condition is satisfied, the process shifts to step S19. On the other hand, when it is determined that the defrosting end condition is not satisfied, step S18 is repeated.

In step S19, the control unit 9 ends the defrosting operation and changes the connection state of the four-way switching valve 10 to resume the heating operation in which the indoor heat exchanger 32 functions as the radiator for the refrigerant.

After the process of step S19, the process returns to step S10, and the processes described above are repeated. It is needless to say that, in the determination of the predetermined premise situation in step S10 immediately after the defrosting operation, the predetermined premise situation is determined to be satisfied because the situation is not a situation where the compressor 8 has been in a stopped state for a long time. Thus, the heating operation using the first defrosting start condition is performed.

(6) Characteristics (6-1)

In a conventional air conditioning apparatus, for example, only a condition that the temperature of an outdoor heat exchanger falls below a reference temperature, which is determined according to the outside air temperature and humidity, is determined as a condition for starting a defrosting operation for melting frost formed on the outdoor heat exchanger in a heating operation. Thus, the likelihood of formation of frost on the surface of the outdoor heat exchanger is not taken into consideration at all, and the defrosting operation is started using the same condition.

However, in a comparison between a case where the heating operation is started with the surface of the outdoor heat exchanger 11 wet and a case where the heating operation is started with the surface of the outdoor heat exchanger 11 dry, even when the other conditions in the heating operation are the same, frost formation is more likely to progress in the case where the surface of the outdoor heat exchanger 11 is wet and frost formation is less likely to progress in the case where the surface is not wet in reality. Thus, even in a case where the frost formation amount in the outdoor heat exchanger is actually not large, the defrosting operation may be started. In this case, the temperature environment inside a room cannot be promptly improved.

On the other hand, in the air conditioning apparatus 1 of the present embodiment, the strictness of the defrosting start condition is set to be different between the case where the predetermined premise situation is established and the case where the predetermined premise situation is not established taking into the above matters into consideration. Specifically, the defrosting start condition is set to be strict so that the defrosting operation is less likely to be started in the case where the elapsed time from the last stop of the compressor 8 is equal to or longer than the predetermined elapsed time at the start of the heating operation as compared to the case where the elapsed time is not equal to or longer than the predetermined elapsed time. In other words, in the case where the elapsed time from the last stop of the compressor 8 is equal to or longer than the predetermined elapsed time at the start of the heating operation, the second defrosting start condition, which is stricter than the first defrosting start condition which is applied in the case where the elapsed time is not equal to or longer than the predetermined elapsed time, is applied.

In this manner, in the air conditioning apparatus 1 of the present embodiment, in the case where a long time equal to or longer than the predetermined elapsed time elapses from the stop of the compressor 8, it is presumed that frost formed on the surface of the outdoor heat exchanger 11 in the last heating operation has been completely melted, and the surface of the outdoor heat exchanger 11 is already dry, so that frost is less likely to be formed on the surface of the outdoor heat exchanger 11 (frost is less likely to be formed on the surface of the outdoor heat exchanger 11 as compared to the case where the heating operation is started under the situation where the surface of the outdoor heat exchanger 11 is wet). Accordingly, the stricter condition with which the defrosting operation is less likely to be started than the defrosting start condition imposed under the situation where the surface of the outdoor heat exchanger 11 is wet is imposed.

Thus, under the situation where frost is less likely to be formed on the outdoor heat exchanger 11, the defrosting operation is not started even when the first defrosting start condition, which is a looser condition, is satisfied, but started when the second defrosting start condition, which is stricter condition, is satisfied. Accordingly, it is possible to improve the temperature environment inside the room while controlling the execution of the defrosting operation.

In the case where the heating operation is started from a stopped state of the air conditioning apparatus 1, but the elapsed time from the last driving of the compressor 8 is short (the predetermined elapsed time has not passed), it is presumed that the surface of the outdoor heat exchanger 11 is wet. Accordingly, it is possible to perform the defrosting operation at an appropriate timing using the condition with which the defrosting operation is more likely to be started.

(6-2)

In the air conditioning apparatus 1 of the present embodiment, in the case where the elapsed time from the last stop of the compressor 8 is equal to or longer than the predetermined elapsed time, the strict second defrosting start condition is imposed to make the defrosting operation less likely to be started.

In the case where the elapsed time from the last stop of the compressor 8 is equal to or longer than the predetermined elapsed time as described above, even when the inside of the room is heated by the last heating operation, there is a high possibility that the indoor temperature has already dropped, and a user feels cold.

On the other hand, in the air conditioning apparatus 1 of the present embodiment, the second defrosting start condition is imposed to make the defrosting operation less likely to be started under such a situation. Thus, it is possible to promptly improve the temperature environment inside the room by preventing the defrosting operation from being performed to continuously perform the heating operation.

(6-3)

In the air conditioning apparatus 1 of the present embodiment, in the case where the stricter second defrosting start condition is applied in accordance with the determination that the predetermined premise situation is established, but the heating capacity is reduced by frost formed on the outdoor heat exchanger 11 due to a continuous heating operation and the predetermined capacity reduction condition is thereby satisfied, the defrosting operation can be forcibly started regardless of whether the second defrosting start condition is satisfied (refer to the flow of steps S11, S12, S17). Thus, when the capacity is excessively reduced, the defrosting operation for melting frost formed on the outdoor heat exchanger 11 is performed and a return to the heating operation is made. Accordingly, the heating capacity which has been excessively reduced can be recovered. As a result, even when the predetermined premise situation is established, it is possible to prevent the heating capacity from being excessively reduced.

(7) Modifications

In the above embodiment, an example of the embodiment of the present invention has been described. However, there is no intention to limit the present invention to the above embodiment at all, and the present invention is not limited to the above embodiment. It is needless to say that the present invention also includes modes appropriately modified without departing from the gist of the invention.

Further, the above embodiment and a plurality of modifications described below may be appropriately combined consistently with each other.

(7-1) Modification A

The above embodiment descries the case where the condition for starting the defrosting operation is changed to the second defrosting start condition, which is a stricter condition, under the predetermined premise situation where the heating operation is started after a time exceeding the predetermined elapsed time (five hours in the above embodiment) elapses from the last stop of the compressor 8.

However, the predetermined premise situation for applying the stricter second defrosting start condition as the condition for starting the defrosting operation is not limited this situation, and may be a situation described below.

(7-1-1)

For example, the control unit 9 may determine that the predetermined premise situation is established in a case where the temperature of the outdoor heat exchanger 11 (e.g., the temperature detected by the outdoor heat-exchange temperature sensor 42) at the start of the heating operation is equal to or higher than a predetermined temperature (satisfies a predetermined situation temperature condition). In the case where the temperature of the outdoor heat exchanger 11 is equal to or higher than the predetermined temperature value (e.g., equal to or higher than an ambient temperature or the difference from the temperature detected by the outside air temperature sensor 41 is less than a predetermined value), it can be estimated that a sufficient time elapses from when the outdoor heat exchanger 11 is used as the evaporator for the refrigerant last time and the temperature of the outdoor heat exchanger 11 is low, and the temperature of the outdoor heat exchanger 11 is sufficiently high and the surface of the outdoor heat exchanger 11 is dry. Thus, even when the heating operation is started to cause the outdoor heat exchanger 11 to function as the evaporator for the refrigerant, frost is less likely to be formed on the outdoor heat exchanger 11 unlike the case where the heating operation is resumed with the surface of the outdoor heat exchanger 11 wet. Accordingly, even when the defrosting start condition is made strict, it is possible to continue the heating operation while ensuring the evaporation capacity of the outdoor heat exchanger 11 to the extent possible.

The determination of the predetermined situation temperature condition using the temperature of the outdoor heat exchanger 11 is not limited to the determination using the detection temperature of the outdoor heat-exchange temperature sensor 42. For example, the temperature of the refrigerant pipe directly connected to the outdoor heat exchanger 11 (the outdoor heat-exchange liquid-side pipe 20 or the outdoor heat-exchange gas-side pipe 19) to which the temperature of the outdoor heat exchanger 11 is easily transferred may be used. Also in this case, in a manner similar to the determination based on the temperature of the outdoor heat exchanger 11, for example, in a case where the temperature of the refrigerant pipe is equal to or higher than the ambient temperature or the difference from the ambient temperature is less than a predetermined value, it can be estimated that a sufficient time elapses from when the outdoor heat exchanger 11 is used as the evaporator for the refrigerant last time and the temperature of the outdoor heat exchanger 11 is low, and the temperature of the outdoor heat exchanger 11 is sufficiently high and the surface of the outdoor heat exchanger 11 is dry.

(7-1-2)

Further, for example, the control unit 9 may determine that the predetermined premise situation is established in a case where the control unit 9 of the air conditioning apparatus 1 is provided with a clock function for grasping a time of day, and the heating operation is started at the timing that satisfies a predetermined time of day condition which is a condition of time of day previously determined.

The time of day with which the control unit 9 determines that the predetermined premise situation is established is, for example, between 5:00 in the early morning to 10:00.

The air conditioning apparatus 1 is often driven until night (e.g., 21:00) in the previous day and maintained in a stopped state until morning in the next day. In such a case, unlike the state in which the surface of the outdoor heat exchanger 11 is wet when a return from the defrosting operation to the heating operation is made, it can be estimated that the surface of the outdoor heat exchanger 11 is not wet, but dry because a long time has already passed from the stop of the air conditioning apparatus 1.

Thus, also under such a situation where the predetermine time of day condition such as the early morning is satisfied, frost is less likely to be formed on the outdoor heat exchanger 11. Accordingly, even when the defrosting start condition is made strict, it is possible to continue the heating operation while ensuring the evaporation capacity of the outdoor heat exchanger 11 to the extent possible.

(7-1-3)

Further, for example, in a case where the indoor temperature is lower than the set temperature by a predetermined value or more at the start timing of the heating operation, the inside of the room is cold, which is uncomfortable for a user. Thus, it is desired to continue the heating operation as long as possible to promptly raise the indoor temperature. Thus, the control unit 9 may determine that the predetermined premise situation is established in the case where the indoor temperature is lower than the set temperature by the predetermined value or more at the start timing of the heating operation.

In this case, it is possible to promptly raise the indoor temperature while preventing the defrosting operation from being performed to improve the indoor environment.

(7-1-4)

Further, for example, in a case where the indoor temperature is lower than the set temperature by a predetermined value or more even after an elapse of a predetermined period from the start of the heating operation, it takes long time to raise the indoor temperature, and it may be desired to prevent a delay in improving the indoor environment caused by the defrosting operation. Thus, the control unit 9 may determine that the predetermined premise situation is established in the case where the indoor temperature is lower than the set temperature by the predetermined value or more after an elapse of the predetermined period from the start of the heating operation.

Also in this case, it is possible to promptly raise the indoor temperature while preventing the defrosting operation from being performed to improve the indoor environment.

(7-1-5)

Further, for example, in a case where the state of the refrigerant in the refrigerant circuit 6 satisfies a predetermined refrigerant state even after an elapse of a predetermined period from the start of the heating operation, for example, a superheating degree of the refrigerant discharged from the compressor 8 is not equal to or higher than a predetermined value even after the elapse of the predetermined period from the start of the heating operation, it can be presumed that the refrigerant is melted and retained in a refrigerating machine oil. Further, it can also be presumed that the surface of the outdoor heat exchanger is dry due to an elapse of a long time from the stop of the compressor.

Thus, the control unit 9 may determine that the predetermined premise situation is established in the case where the state of the refrigerant in the refrigerant circuit 6 satisfies the predetermined refrigerant state even after an elapse of the predetermined period from the start of the heating operation.

Also in this case, it is possible to promptly raise the indoor temperature while preventing the defrosting operation from being performed to improve the indoor environment.

(7-2) Modification B

The above embodiment describes, as an example, the case where, in the case where the start of the defrosting operation is controlled by imposing the first defrosting start condition, which is a looser condition, when the predetermined premise situation is not established and imposing the second defrosting start condition, which is a stricter condition, when the predetermined premise situation is established, the defrosting operation is forcibly started regardless of whether the second defrosting start condition is satisfied in the case where the predetermined premise situation is established, but the predetermined capacity reduction condition is satisfied.

However, the process for facilitating the defrosting operation even through the second defrosting start condition is not satisfied in the case where the predetermined premise situation is established is not limited to this example. For example, a process described below may be performed.

(7-2-1)

For example, when it is determined that the predetermined capacity reduction condition is satisfied in step S12 in the flowchart of the above embodiment, the defrosting operation is not immediately forcibly started, but the defrosting start condition is relaxed from the second defrosting start condition to the first defrosting start condition to facilitate the defrosting operation.

(7-2-2)

Further, for example, instead of determining the predetermined capacity reduction condition based on the condensation temperature of the refrigerant detected by the indoor heat-exchange temperature sensor 53 as described in the above embodiment, the control unit 9 may determine that the predetermined capacity reduction condition is satisfied in a case where the air temperature of an air flow that has been generated by the indoor fan 33 and has passed through the indoor heat exchanger 32 is equal to or lower than a predetermined temperature. In this case, it is possible to grasp a reduction in the capacity from a reduction in the temperature of air supplied into the room and forcibly start the defrosting operation. The defrosting operation may not be forcibly started, but the defrosting start condition may be relaxed from the second defrosting start condition to the first defrosting start condition to facilitate the defrosting operation in manner similar to the above configuration.

(7-2-3)

Further, for example, instead of determining the predetermined capacity reduction condition based on the condensation temperature of the refrigerant detected by the indoor heat-exchange temperature sensor 53 as described above, the control unit 9 may determine that the predetermined capacity reduction condition is satisfied in a case where a predetermined time elapses with the outdoor heat-exchange temperature detected by the outdoor heat-exchange temperature sensor 42 maintained equal to or lower than a first defrosting determination value (first temperature) which is used in the determination of the first defrosting start condition. Such a capacity reduction condition can be used in the determination because it can be estimated that, in the case where the predetermined time elapses with the outdoor heat-exchange temperature maintained equal to or lower than the first defrosting determination value (first temperature) which is used in the determination of the first defrosting start condition, the evaporation capacity of the outdoor heat exchanger 11 is reduced by a large amount of frost already formed on the outer surface of the outdoor heat exchanger 11, which also reduces the heating capacity.

(7-2-4)

Further, for example, instead of determining whether the predetermined capacity reduction condition is satisfied in step S12 and step S15 in the flowchart of the above embodiment, the control unit 9 may determine whether a predetermined reliability condition relating to the reliability of the compressor 8 is satisfied to forcibly start the defrosting operation when a sufficient reliability of the compressor 8 should be ensured.

Figure 4:
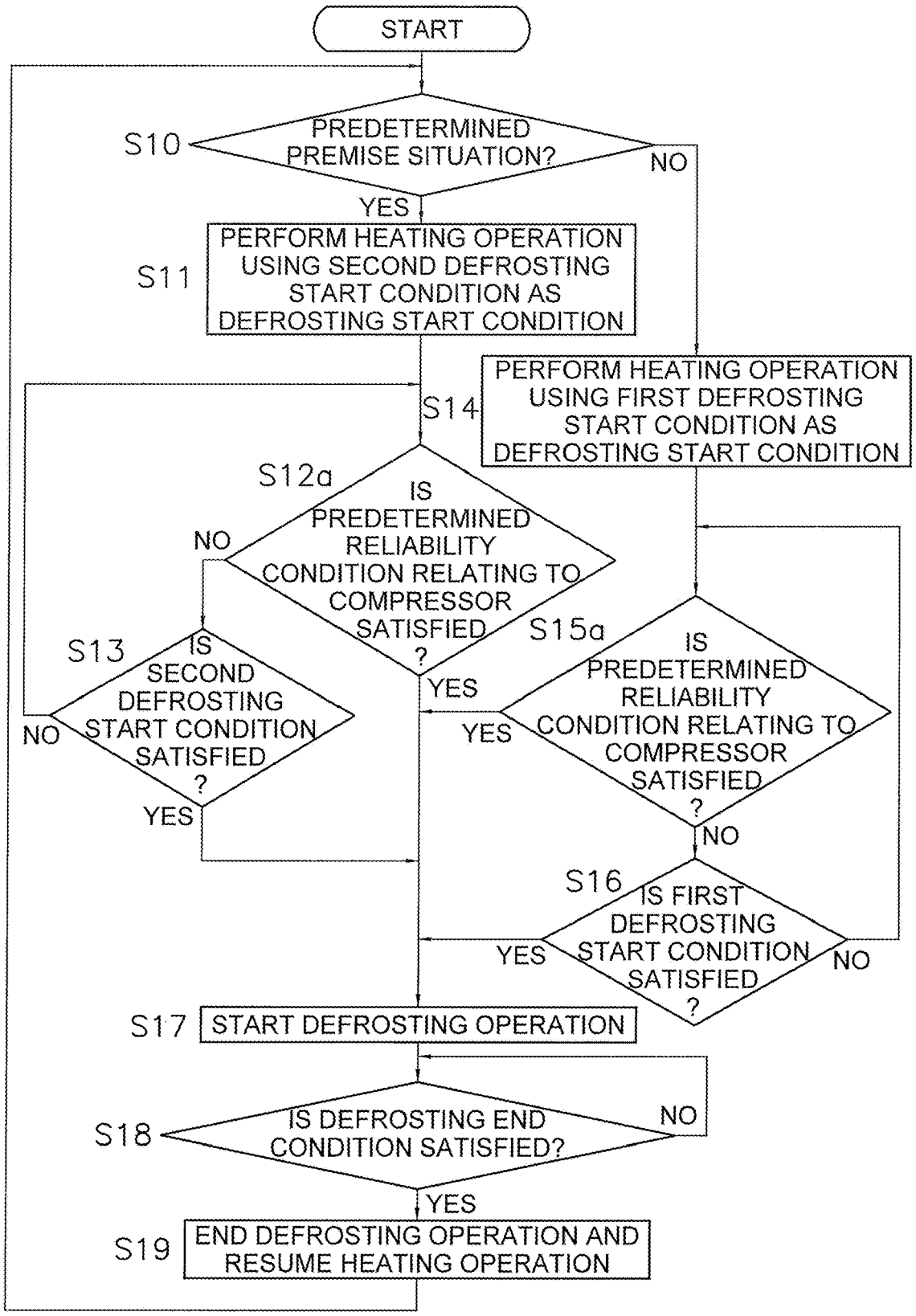
FIG. 4 is a control flowchart relating to a defrosting operation according to a modification (7-2-4).

Specifically, as illustrated in the flowchart of FIG. 4, instead of performing the determination of the capacity reduction in step S12 of the above embodiment, step S12*a* in which the control unit 9 determines whether the predetermined reliability condition relating to the compressor 8 is satisfied may be executed. Further, instead of performing the determination of the capacity reduction in step S15 of the above embodiment, step S15*a*, which is similar to step S12*a*, may be executed.

The determination of the reliability of the compressor 8 in step S12*a* may be performed when "No" is determined in step S12 of the above embodiment to perform both the determination of the capacity reduction and the determination of the reliability of the compressor 8. Further, similarly, the determination of the reliability of the compressor 8 in step S15*a* may be performed when "No" is determined in step S15 of the above embodiment to perform both the determination of the capacity reduction and the determination of the reliability of the compressor 8. Also in these cases, whichever the determination of the capacity reduction or the determination of the reliability of the compressor 8 may be performed first.

The predetermined reliability condition may be, for example, a condition which is satisfied when the superheating degree of the refrigerant sucked into the compressor 8 is equal to or lower than a predetermined reliability suction superheating degree or a condition which is satisfied when the superheating degree of the refrigerant discharged from the compressor 8 is equal to or lower than a predetermined reliability discharge superheating degree.

In a case where, in the heating operation, the heating operation is continuously executed without performing the defrosting operation, and the predetermined reliability condition is satisfied, it can be presumed that the refrigerant does not sufficiently evaporate due to a reduction in the evaporation capacity of the outdoor heat exchanger 11 caused by frost formed on the outdoor heat exchanger 11, which reduces the superheating degree of the refrigerant sucked into the compressor 8 or the refrigerant discharged from the compressor 8, and the liquid refrigerant which has not evaporated may be sucked into the compressor 8 (liquid compression may occur). Thus, under such a situation, the defrosting operation is forcibly executed to melt the frost formed on the outdoor heat exchanger 11 to recover the evaporation capacity of the outdoor heat exchanger 11 and the heating operation is then resumed. Accordingly, a sufficient reliability of the compressor 8 can be ensured.

Also in this case, the defrosting operation may not be forcibly started, but the defrosting start condition may be relaxed from the second defrosting start condition to the first defrosting start condition to facilitate the defrosting operation in a manner similar to the above.

(7-2-5)

Further, for example, instead of determining whether the predetermined capacity reduction condition is satisfied in step S12 and step S15 in the flowchart of the above embodiment, the control unit 9 may determine whether a heating load of the air conditioning apparatus 1 satisfies a predetermined low-load condition to facilitate the start of the defrosting operation under the situation where the heating load is small.

Figure 5:
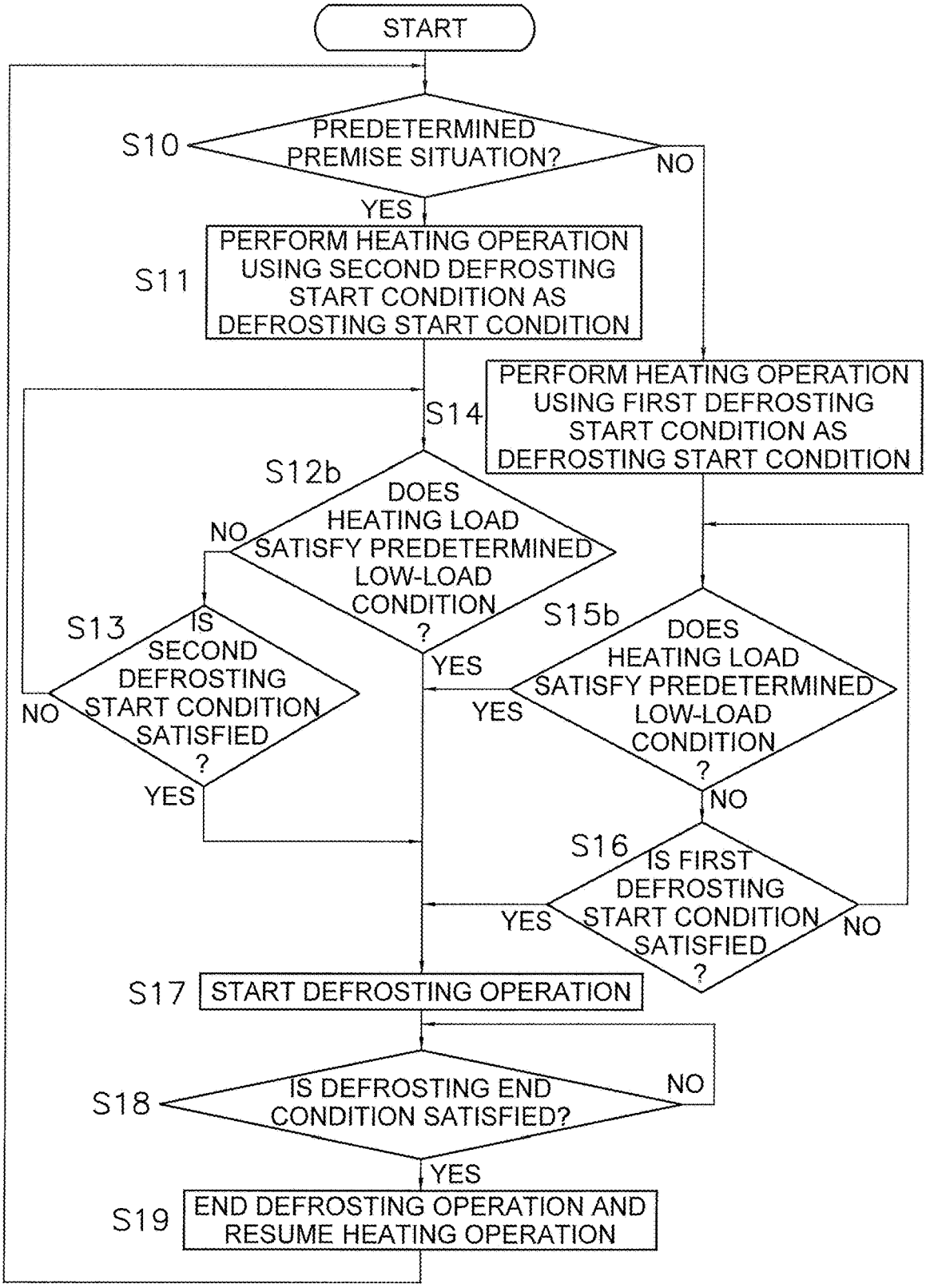
FIG. 5 is a control flowchart relating to a defrosting operation according to a modification (7-2-5).

That is, as illustrated in the flowchart of FIG. 5, instead of performing the determination of the capacity reduction in step S12 of the above embodiment, step S12*b* in which the control unit 9 determines whether the heating load of the air conditioning apparatus 1 satisfies the predetermined low-load condition may be executed. Further, instead of performing the determination of the capacity reduction in step S15 of the above embodiment, step S15*b* which is similar to step S12*b* may be executed.

The determination of the heating load reduction in step S12*b* may be performed when "No" is determined in step S12 of the above embodiment to perform both the determination of the capacity reduction and the determination of the heating load reduction. Further, similarly, the determination of the heating load reduction in step S15*b* may be performed when "No" is determined in step S15 of the above embodiment to perform both the determination of the capacity reduction and the determination of the heating load reduction. In these cases, whichever the determination of the capacity reduction or the determination of the heating load reduction may be performed first. Further, the determination of the reliability of the compressor 8 described in the modification (7-2-4) may also be additionally performed.

The predetermined low-load condition may be, for example, a condition which is satisfied when the indoor temperature rises and reaches the set temperature by performing the heating operation and the driving of the compressor 8 is thereby stopped (thermo-OFF) or a condition which is satisfied when the indoor temperature rises and the difference from the set temperature becomes equal or less than a predetermined temperature difference by performing the heating operation.

In a case where the indoor temperature reaches the set temperature or the difference from the set temperature is reduced during the heating operation, it is insignificant to continue the heating operation by preventing the defrosting operation, and it is desired to actively perform the defrosting operation in order to recover the evaporation capacity of the outdoor heat exchanger 11. Thus, under such a situation, it is possible to ensure a comfortable state of the temperature environment inside the room and further recover the evaporation capacity of the outdoor heat exchanger 11 by the defrosting operation.

As described above, for example, when the heating load of the air conditioning apparatus 1 satisfies the predetermined low-load condition, the second defrosting start condition which has been imposed as the defrosting start condition may be relaxed to the first defrosting start condition to facilitate the start of the defrosting operation.

(7-3) Modification C

The above embodiment describes, as an example, the case where the second defrosting determination value in the second defrosting start condition is set lower than the first defrosting determination value in the first defrosting start condition so that the second defrosting start condition is stricter than the first defrosting start condition.

However, an example of the first defrosting start condition and the second defrosting start condition is not limited to this example.

For example, although the above embodiment describes, as an example, the case where a specific value which is previously fixed is used as each defrosting determination value such that the first defrosting determination value is, for example, −10° C. and the second defrosting determination value is, for example, −20° C., each of the first defrosting determination value and the second defrosting determination value may be, for example, a value determined as a function of the outside air temperature. Even when each of the defrosting determination values is the value determined as the function of the outside air temperature in this manner, each function is previously determined so that the second defrosting determination value is lower than the first defrosting determination value. These functions are preferably determined so that both the first defrosting determination value and the second defrosting determination value become lower as the outside air temperature becomes lower.

Further, for example, the first defrosting determination value in the first defrosting start condition and the second defrosting determination value in the second defrosting start condition may be set to the same value, and a condition that the temperature of the outdoor heat exchanger 11 is equal to or lower than the first defrosting determination value is used in the first defrosting start condition and a condition that a state in which the temperature of the outdoor heat exchanger 11 is equal to or lower than the second defrosting determination value is continued for a predetermined time or longer is used in the second defrosting start condition.

In this case, the first defrosting start condition is satisfied when the temperature of the outdoor heat exchanger 11 temporarily becomes equal to or lower than the first defrosting determination value. On the other hand, in the second defrosting start condition, it is necessary for the temperature of the outdoor heat exchanger 11 to be continuously maintained equal to or lower than the second defrosting determination value (here, equal to the first defrosting determination value) for the predetermined time. In this point, the second defrosting start condition is stricter than the first defrosting start condition.

Further, not only the condition of the outside air temperature, but also the condition of humidity may be imposed on each of the first defrosting start condition and the second defrosting start condition. In this case, it is possible determine the degree of frost formation in the outdoor heat exchanger 11 in more detail.

(7-4) Modification D

In a case where the operation of the air conditioning apparatus 1 of the above embodiment is stopped in a predetermined night time period (the operation is stopped in a time period during which it is assumed that the heating operation is not started for a predetermined period (e.g., five hours or longer)), the defrosting operation may be performed immediately before the operation stop to previously melt frost formed on the outdoor heat exchanger 11.

Accordingly, it is possible to shorten the time required to dry the surface of the outdoor heat exchanger 11 after the operation stop and reliably dry the surface of the outdoor heat exchanger 11 before the heating operation is started in the next morning or the like. Thus, it is possible to ensure the situation where frost is less likely to adhere to the outdoor heat exchanger 11 in the heating operation in the early morning.

(7-5) Modification E

The above embodiment describes, as an example, the case where the defrosting operation is performed with the connection state of the four-way switching valve 10 switched so that the discharge side of the compressor 8 is connected to the outdoor heat exchanger 11.

However, the defrosting operation is not limited to this example. For example, the compressor 8 may be driven at the number of revolutions equal to or higher than a predetermined number of revolutions with the connection state of the four-way switching valve 10 switched so that the discharge side of the compressor 8 is connected to the indoor heat exchanger 32 to increase the refrigerant circulation amount in the refrigerant circuit 6, thereby melting frost formed on the outdoor heat exchanger 11. When this defrosting operation is performed, the valve opening degree of the outdoor expansion valve 12 is preferably increased to equal to or larger than a predetermined opening degree in order to increase the refrigerant pressure in the outdoor heat exchanger 11.

Further, as the defrosting operation, the driving of the compressor 8 may be stopped and the outdoor fan 15 may be driven to melt frost formed on the outdoor heat exchanger 11.

These defrosting operations are the same as the defrosting operation in the above embodiment in that the refrigerant pressure (condensation pressure) inside the indoor heat exchanger 32 is reduced as compared to the heating operation, and the temperature environment inside the room is deteriorated.

(7-6) Modification F

The above embodiment describes, as an example, the case where the adjustment of the airflow volume of the outdoor fan 15 in the heating operation is performed in any manner.

On the other hand, for example, the control unit 9 may perform airflow volume control in such a manner that the airflow volume of the outdoor fan 15 is reduced when the temperature of the outdoor heat exchanger 11 becomes equal to or lower than a predetermined first airflow volume control temperature, which is higher than the first defrosting determination value, in the case where the predetermined premise situation is not established, and the airflow volume of the outdoor fan 15 is reduced when the temperature of the outdoor heat exchanger 11 becomes equal to or lower than a predetermined second airflow volume control temperature, which is higher than the second defrosting determination value and lower than the first airflow volume control temperature, in the case where the predetermined premise situation is established.

Such airflow volume control makes it possible to also lower the temperature of the outdoor heat exchanger 11, which is a determination criterion for reducing the airflow volume of the outdoor fan 15, from the first airflow volume control temperature to the second airflow volume control temperature in a similar manner corresponding to lowering the determination temperature from the first defrosting determination value in the first defrosting start condition to the second defrosting determination value of the second defrosting start condition according to the predetermined premise situation.

When the airflow volume of the outdoor fan 15 remains large with frost formed on the outdoor heat exchanger 11, a blowing sound may become large. However, the noise can be reduced by performing the airflow volume control according to the frost formation amount estimated according to the predetermined premise situation as described above.

(7-7) Modification G

The above embodiment describes, as an example, the case where it is determined whether the temperature detected by the outdoor heat-exchange temperature sensor 42 is equal to or lower than the first defrosting determination value or the second defrosting determination value in the determination of the first defrosting start condition or the second defrosting start condition.

However, the temperature of the refrigerant flowing through the outdoor heat-exchange liquid-side pipe 20 which connects the outdoor heat exchanger 11 and the outdoor expansion valve 12 may be compared with the first defrosting determination value or the second defrosting determination value in the determination of the first defrosting start condition or the second defrosting start condition. Also in this case, it is possible to grasp the degree of frost formation in the outdoor heat exchanger 11 in a manner similar to the above embodiment.

REFERENCE SIGNS LIST

1 air conditioning apparatus (refrigeration apparatus)
2 outdoor unit
3 indoor unit
6 refrigerant circuit
8 compressor
9 control unit
11 outdoor heat exchanger
12 expansion valve (expansion mechanism)
19 outdoor heat-exchange gas-side pipe (refrigerant pipe connected to outdoor heat exchanger)
20 outdoor heat-exchange liquid-side pipe (refrigerant pipe connected to outdoor heat exchanger, refrigerant pipe connecting outdoor heat exchanger and expansion mechanism)
32 indoor heat exchanger
41 outside air temperature sensor
42 outdoor heat-exchange temperature sensor
43 outdoor heat-exchange liquid-side temperature sensor
44 discharge pressure sensor
45 discharge temperature sensor
46 suction temperature sensor
51 indoor air temperature sensor
52 indoor heat-exchange liquid-side temperature sensor
53 indoor heat-exchange temperature sensor

CITATION LIST

Patent Literature

Patent Literature 1: JP 63-188448 A

The invention claimed is:

1. A refrigeration apparatus comprising:

a refrigerant circuit including a compressor, an outdoor heat exchanger, an expansion mechanism, and an indoor heat exchanger connected to each other, the refrigerant circuit being capable of executing at least a heating operation by circulating a refrigerant through the refrigerant circuit; and a controller configured to start a defrosting operation for melting frost formed on the outdoor heat exchanger when a first defrosting start condition is satisfied in a case where a predetermined premise situation is not established and start the defrosting operation when a second defrosting start condition stricter than the first defrosting start condition is satisfied in a case where the predetermined premise situation is established, wherein the predetermined premise situation is satisfied in at least any of the following cases:

a case where an elapsed time from a last stop of the compressor is equal to or longer than a predetermined elapsed time at a start of the heating operation;

a case where a time of day at the start of the heating operation satisfies a predetermined time of day condition;

a case where a temperature of the outdoor heat exchanger or a refrigerant pipe connected to the outdoor heat exchanger is equal to or higher than a predetermined temperature at the start of the heating operation;

a case where a difference between a set temperature and an indoor temperature is equal to or larger than a predetermined value at the start of the heating operation; and a case where a state of the refrigerant in the refrigerant circuit satisfies a predetermined refrigerant state or the difference between the set temperature and the indoor temperature is equal to or larger than a predetermined value after an elapse of a predetermined period from the start of the heating operation.

2. The refrigeration apparatus according to claim 1, wherein the controller forcibly starts the defrosting operation regardless of whether the second defrosting start condition is satisfied or starts the defrosting operation when the first defrosting start condition is satisfied in any of the following cases:

a case where a heating capacity satisfies a predetermined capacity reduction condition;

a case where a predetermined reliability condition relating to a reliability of the compressor is satisfied; and a case where a load of the heating operation satisfies a predetermined low-load condition.

3. The refrigeration apparatus according to claim 2, wherein the case where the heating capacity satisfies the predetermined capacity reduction condition is at least any of the following cases:

a case where a condensation temperature of the refrigerant in the indoor heat exchanger is equal to or lower than a predetermined temperature;

a case where a temperature of air that has passed through the indoor heat exchanger is equal to or lower than a predetermined temperature; and a case where the first defrosting start condition includes a condition that a temperature of the outdoor heat exchanger or a refrigerant pipe connecting the outdoor heat exchanger and the expansion mechanism is equal to or lower than a predetermined reference temperature, and a predetermined time elapses with the temperature of the outdoor heat exchanger or the refrigerant pipe connecting the outdoor heat exchanger and the expansion mechanism maintained equal to or lower than the predetermined reference temperature.

4. The refrigeration apparatus according to claim 1, wherein the first defrosting start condition includes a condition that a temperature of the outdoor heat exchanger or a refrigerant pipe connecting the outdoor heat exchanger and the expansion mechanism is equal to or lower than a predetermined first temperature, and the second defrosting start condition includes a condition that the temperature of the outdoor heat exchanger or the refrigerant pipe connecting the outdoor heat exchanger and the expansion mechanism is equal to or lower than a predetermined second temperature lower than the first temperature.

* * * * *